United States Patent [19]

Russell et al.

[11] Patent Number: 4,718,211

[45] Date of Patent: Jan. 12, 1988

[54] BATTEN BAR FOR SINGLE PLY MEMBRANE USED ON ROOFS

[75] Inventors: Kerston R. Russell, Lake County, Ill.; Robert A. Tubbesing, St. Louis County, Mo.

[73] Assignee: Greenstreak Plastic Products Company, St. Louis, Mo.

[21] Appl. No.: 924,365

[22] Filed: Oct. 29, 1986

[51] Int. Cl.[4] ..... E04D 5/14

[52] U.S. Cl. ..... 52/409; 52/410; 52/551; 52/746; 52/748

[58] Field of Search ..... 52/409, 410, 411, 412, 52/413, 394, 748, 467, 459, 417, 419, 420, 551, 746, 747, 543, 96, 11; D25/74, 79, 75

[56] References Cited

U.S. PATENT DOCUMENTS

| | | | |
|---|---|---|---|
| 1,334,178 | 3/1920 | Sharp | 52/418 |
| 1,416,888 | 5/1922 | Schumacher | 52/467 |
| 1,724,601 | 8/1929 | Kellogg | 52/467 |
| 1,972,545 | 9/1934 | Warren | 52/716 |
| 2,599,322 | 6/1952 | Drain | 52/467 |
| 2,923,386 | 2/1960 | Harry | 52/394 |
| 3,263,385 | 8/1966 | Paul | 52/467 |
| 3,305,993 | 2/1967 | Nelsson | 52/459 |
| 3,775,926 | 12/1973 | Brown | 52/312 |
| 4,437,283 | 3/1984 | Benoit | 52/11 |
| 4,445,306 | 5/1984 | Schauffeic | 52/410 |

FOREIGN PATENT DOCUMENTS

| | | | |
|---|---|---|---|
| 2336229 | 2/1975 | Fed. Rep. of Germany | 52/748 |

*Primary Examiner*—John E. Murtagh
*Attorney, Agent, or Firm*—Rey Eilers

[57] ABSTRACT

The present invention provides a batten bar of plastic, corrosion-resistant, material which has thick side portions that resist curling, kinking, looping and distorting of that bar, even when the fasteners that are used to secure that bar and the underlying membrane to a roof are overdriven. That batten bar has a connecting or bridging portion between the thick side portions thereof; and the upper surface of that bridging portion is displaced below the upper surfaces of the thick side portions to form an elongated groove which is at least as deep as the head of a fastener which is used to secure that bar and the underlying membrane to a roof.

9 Claims, 6 Drawing Figures

FIG. 1.
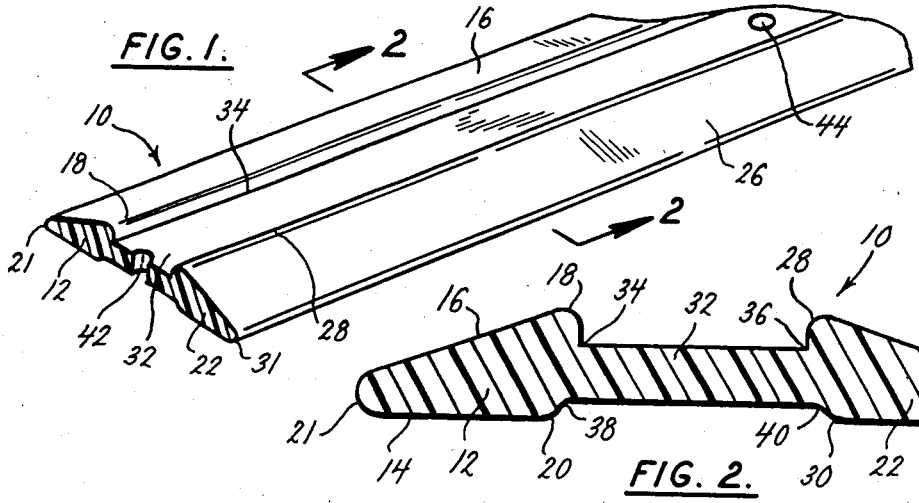
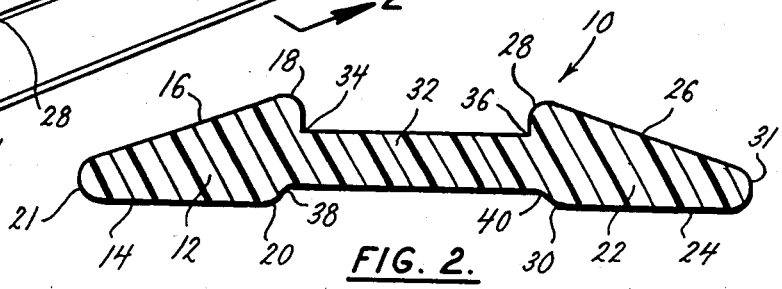
FIG. 2.
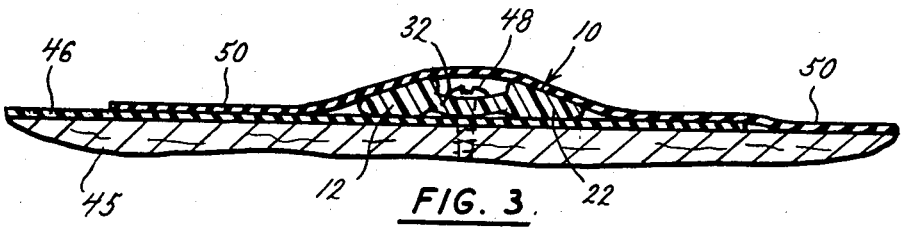
FIG. 3.
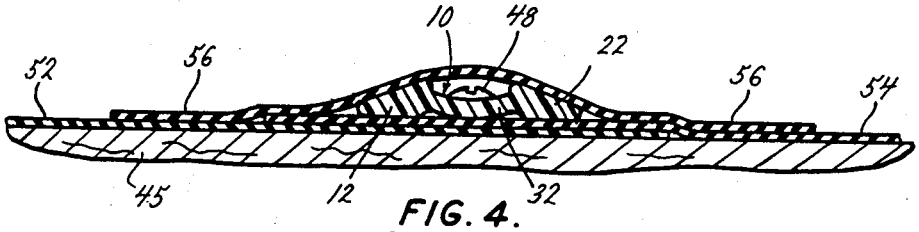
FIG. 4.
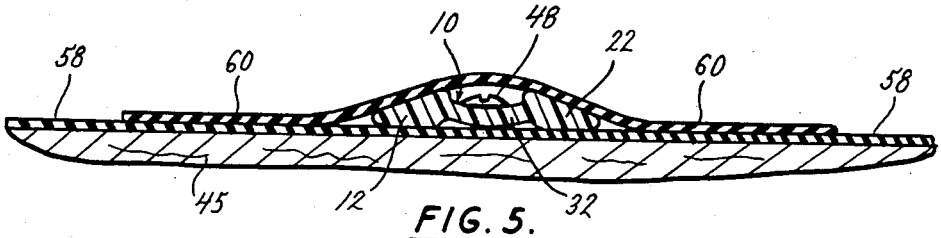
FIG. 5.
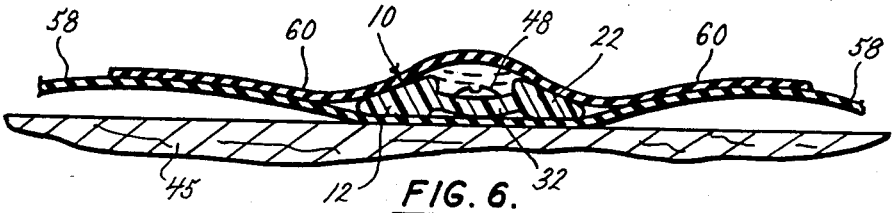
FIG. 6.

BATTEN BAR FOR SINGLE PLY MEMBRANE USED ON ROOFS

BACKGROUND OF THE INVENTION

1. Field of the Invention

This invention relates to methods of, and apparatus for, securing single ply membranes to roofs. Those membranes are made of thermoplastic or elastomeric material; and they are laid directly on roofs or on substrates on roofs. It is important to secure the single ply membranes in an inexpensive but effective manner.

2. Description of the Prior Art

Single ply membranes are customarily held in place on roofs or on substrates on roofs by (a) placing river gravel or concrete pavers on the top surfaces of those membranes to hold them in position, (b) using adhesive to bond the single ply membranes to substrates on the roofs, or (c) placing batten bars on the single ply membranes at spaced intervals and then passing fasteners downwardly through those bars and those membranes to secure those batten bars and membranes to the roofs.

River gravel is desirable because it is largely free of sharp edges; but river gravel is not always available in quantity at economical prices. Concrete pavers are more expensive than river gravel; and they do not have the desirable rounded surfaces of river gravel. Also, whether river gravel or concrete pavers are used, they constitute an undesirable constant dead weight on a roof, because current practices call for a minimum loading of ten pounds per square foot of roof. Also, river gravel and concrete pavers impede free pedestrian or vehicular movement across roofs. As a result, the use of river gravel or concrete pavers to secure single ply membranes to roofs is objectionable.

Where an adhesive is used to secure single ply membranes to substrates on roofs, the adhesive must be compatible with the material of the membranes and also must be compatible with the material of the substrates on the roofs. A substrate usually takes the form of insulation that is mechanically secured to the roof by fasteners or is adhered to the roof by asphalt. Where insulation is adhered to the roof by asphalt, additional securement of that insulation against lateral shifting is usually required. A critical problem in the use of adhesives to secure single ply membranes to substrates on roofs is the problem of avoiding wrinkles as the membranes are placed in engagement with the adhesive-coated substrates; and a further critical problem is the attainment of a complete bond of the membranes to the substrates. Also, the amount of adhesive, the cost of fasteners or asphalt used to secure the substrates to the roofs, and the time involved in keeping wrinkles from forming in the membranes can make the use of adhesives, to secure single ply membranes to roofs, relatively expensive.

The use of batten bars to secure single ply membranes to roofs avoids the dead weight constituted by river gravel or concrete pavers, provides minimum impedance to pedestrian or vehicular traffic on roofs, avoids the wrinkling that frequently occurs when the membranes are secured to substrates on roofs by adhesives, and is less expensive than river gravel, concrete pavers or adhesives. However, the batten bars which have been used heretofore have been objectionable because they were made from metal, and hence could not be drilled without exposing the walls of the drilled holes therein to corrosive attack. Also, the oils on the upper surfaces of those bars made it difficult for an adhesive to provide firm adhesion between those surfaces and an overlying membrane. In addition, burrs and jagged formations on the edges of bars, which were formed by a punching operation, could abrade or penetrate an overlying membrane. Moreover, the edges of metal bars tended to curl upwardly and/or the bars tended to loop and kink or distort those edges when fasteners were passed downwardly through the bars and membrane to seat in a roof and then overtightened; and those edges could abrade and/or penetrate an overlying membrane. When the bars were made of heavy gauge metal to reduce the curling, kinking, looping and distortion, the cutting of bars from large coils became a problem. Furthermore, the heads of fasteners extended upwardly above the surfaces of the metal bars and resulted in abrasion or penetration of the membranes. Where the batten bars were made from aluminum, the cost was high and the gauge of metal was thick. Where the batten bars were made from galvanized metal the bars were subject to corrosion, particularly where they were drilled or were cut to length in the field. As a result, the use of metal batten bars to secure single ply membranes to roofs has been objectionable.

SUMMARY OF THE INVENTION

The present invention provides a batten bar of plastic, corrosion-resistant, material which has thick side portions that resist curling, kinking, looping and distorting of that bar, even when the fasteners that are used to secure that bar and the underlying membrane to a roof are overdriven. It is, therefore, an object of the present invention to provide a batten bar of plastic, corrosion-resistant, material which has thick side portions.

The batten bar of the present invention has a connecting or bridging portion between the thick side portions thereof; and the thickness of that bridging portion is less than the thickness of either of the thick side portions. Also, the upper surface of that bridging portion is displaced below the upper surfaces of the thick side portions to form an elongated groove which is at least as deep as the head of a fastener which is used to secure that bar and the underlying membrane to a roof. Also, the lower surface of that bridging portion is displaced above the lower surfaces of the thick side portions to form an elongated space. The lesser thickness of the bridging portion enables the under surface of that bridging portion to be bent downwardly into engagement with the upper surface of an underlying membrane without causing any curling, kinking, or distortion of either of the outer edges of the thick side portions. Also, the engagement between the downwardly-bent under surface of the bridging portion and the upper surface of an underlying membrane will coact with the engagements between the under surfaces of the thick side portions and that underlying membrane to provide three elongated areas of engagement, between the batten bar and the underlying membrane, which are surface-to-surface engagements. As a result the batten bar of the present invention can provide well-distributed forces to any underlying membrane to help secure that membrane to a roof. It is, therefore, an object of the present invention to provide a batten bar which has a bridging portion between the thick side portions thereof, which has the upper surface of that bridging portion displaced below the upper surfaces of those side portions, and which has the lower surface of that bridging portion displaced above the lower surfaces of those side portions.

The batten bar provided by the present invention is extruded, and hence has extrusion-smooth surfaces. Those surfaces are initially, and will remain, free from burrs; and hence the batten bar of the present invention will not tend to abrade or penetrate an overlying or an underlying membrane. Also, the outer edges of the side portions are smoothly rounded, and the parts of the upper surfaces of those side portions which are adjacent the bridging portion are smoothly rounded, and hence the batten bar will not tend to abrade or penetrate an overlying or an underlying membrane. It is, therefore, an object of the present invention to provide a batten bar which has extrusion-smooth surfaces, which has smoothly rounded outer edges, and which has smoothly rounded upper surfaces.

The batten bar provided by the present invention is made from a plastic material which is sturdy and rugged but which can be "cut" to length by the formation of a notch therein and by the subsequent application of bending forces thereto adjacent that notch. The resulting break or "cut" is free of burrs, is easily made, and does not cause any bending or distorting of the cut-off section. It is, therefore, an object of the present invention to provide a batten bar which is made from a plastic material that is rugged but which can be "cut" to length by the formation of a notch therein and by the subsequent application of bending forces thereto.

Other and further objects and advantages of the present invention should become apparent from an examination of the drawing and accompanying description.

In the drawing and accompany description, a preferred embodiment of the invention is shown and described, but it is to be understood that the drawing and accompanying description are for the purpose of illustration and do not limit the invention and that the invention will be defined by the appended claims.

BRIEF DESCRIPTION OF THE DRAWING

FIG. 1 is a perspective view of one embodiment of batten bar which is made in accordance with the principles and teachings of the present invention;

FIG. 2 is a cross sectional view which is taken along a plane identified the line 2—2 in FIG. 1;

FIG. 3 is a vertical section through the bar of FIG. 1 and through the overlapping edges of two single ply membranes;

FIG. 4 is a vertical section through the bar of FIG. 1 and of three membranes which form a "joint";

FIG. 5 is a vertical section through the bar of FIG. 1 and two membranes; and

FIG. 6 is a vertical section which is similar to the vertical section in FIG. 5, but which shows how wind or negative pressure can cause portions of an underlying, plus portions of an overlying, membrane to flex relative to the bar of FIG. 1.

DESCRIPTION OF THE PREFERRED EMBODIMENT

Referring to the drawing in detail, the numeral 10 generally denotes a preferred embodiment of batten bar which is made in accordance with the principles and teachings of the present invention. That bar has an elongated side portion which is generally denoted by the numeral 12; and that portion has a substantially flat lower surface 14, a substantially flat, inclined, upper surface 16, a rounded upper edge 18, a rounded offset 20, and a rounded outer or side edge 21. The bar 10 has a second elongated side portion 22 which is a mirror image of the elongated side portion 12—having a substantially flat lower surface 24, a substantially flat, inclined, upper surface 26, a rounded upper edge 28, a rounded offset 30, and a rounded outer or side edge 31. The bar 10 has a connecting or bridging portion 32 that has a substantially flat, upper surface which merges with the lower inner end of the rounded upper edge 18 of side portion 12 at a change of curvature 34, and which merges with the lower inner end of the rounded upper endge 28 of side portion 22 at a change of curvature 36. The under surface of the bridging portion 22 merges with the offset 20 of side portion 12 at a change of curvature 38, and that under surface merges with the offset 30 at a change of curvature 40. Holes 42 and 44 are provided in the bridging portion 32; and the axes of those holes are parallel to each other, but are perpendicular to the upper surface of the bridging portion 32.

In the preferred embodiment of batten bar 10 that is shown in FIG. 1, the distance between the outermost portions of the rounded outer or side edges 21 and 31 is about one and seven-sixteenths (1-7/16) inches, the width of the substantially flat part of each of the lower surfaces 14 and 24 is about three-eights ($\frac{3}{8}$) of an inch, and the distance from the uppermost part of each of the rounded upper edges 18 and 28 to the level of the lower surfaces 14 and 24 is about one quarter ($\frac{1}{4}$) of an inch. The width of the upper surface of the bridging portion 32 is about one-half ($\frac{1}{2}$) of an inch, the width of the lower surface of that bridging portion is about five-eighths ($\frac{5}{8}$) of an inch, and the vertical dimension of that bridging portion is slightly less than three-sixteenths (3/16) of an inch. The upper surface of the bridging portion 32 merges with the side portions 12 and 22 at points which are above the vertical mid-points of those side portions—that upper surface of that bridging portion being displaced about one-sixteenth (1/16) of an inch below the levels of the uppermost parts of the rounded upper edges 18 and 28. The lower surface of that bridging portion is spaced slightly less than one-sixteenth (1/16) of an inch above the level of the lower surfaces 14 and 24 of the side portions 12 and 22.

It will be noted that the changes of curvature 38 and 40, at the sides of the lower surfaces of the bridging portion 32, are spaced further apart than the changes of curvature 34 and 36 at the sides of the upper surface of that bridging portion. That relationship, plus the fact that the upper surface of the bridging portion 32 merges with the side portions 12 and 22 at points above the vertical mid-points of those side portions enables the upper part of that bridge portion to apply rotation-resisting compressive forces to the upper parts of the side portions 12 and 22 when a downwardly-directed force is applied to that bridging portion. Also, that relationship causes that bridging portion to bend downwardly and thereby relieve shear forces on the outer areas of that bridging portion when a heavy, downwardly-directed force is applied to that bridging portion. Specifically, when a fastener 48 has the shank thereof passed downwardly through one of the holes 42 or 44 until the head thereof engages, and applies a downwardly-directed force to, the bridging portion 32, that force will be transmitted by that bridging portion to the side portions 12 and 22, and thence to the lower surfaces 14 and 24 of those side portions. That bridging portion is resistant to bending; and hence it will be able to cause the bar 10 to apply substantial, downwardly-directed forces at the lower surfaces 14 and 24 before a downwardly-directed force can cause that bridging portion to bend. However, if an excessively-large, downwardly-directed force is applied to the bridging portion 32 by the head of the fastener 48, the center of that bridging portion will bend downwardly toward the plane which is defined by the lower surfaces 14 and 24 of the side portins 12 and 22. As that bridging portion engages the underlying surface on which the lower surfaces 14 and 24 are resting, that bridging portion will limit the application of heavier forces to those lower surfaces, and the vertically directed compressive forces which will be developed within that bridging portion will prevent further over-driving of the fastener without any injury to the bar 10. Also, when the bridging portion 32 engages the underlying surface on which the lower surfaces 14 and 24 are resting, compressive forces which had developed in the upper part thereof, and tensile forces which had developed in the lower part thereof, will be applied to the upper and lower areas of the confronting faces of the side portions 12 and 22; and those forces will tend to resist clockwise rotation of side portion 12 and to resist counterclockwise rotation of side portion 22. As a result, the bar 10 will tend to keep the lower surfaces 14 and 24 close to the same plane, even when excessive downwardly-directed forces are applied to the bridging portion 32 thereof.

Whenever the bridging portion 32 remains unbent, despite the application thereto of downwardly-directed forces, the bar 10 will cause the lower surfaces 14 and 24 to apply two elongated, laterally-spaced downwardly-directed forces to the surface underlying that bar. Those lower surfaces will be in face-to-face contact with that underlying surface, and hence the bar 10 will provide two elongated, laterally-spaced full areas of enforced contact with that underlying surface. If an excessive force is applied to the bridging portion 32 and is able to cause it to bend downwardly, the shear effect of that downwardly-directed force will be limited by the bending of that bridging portion. Also, as the center of that bridging portion bends downwardly, the resulting restorative forces within that bridging portion will cause that bridging portion to apply even larger downwardly-directed forces to the side portions 12 and 22—and hence to the surface which underlies the lower surfaces 14 and 24 of those side portions. This means that as the bending of the bridging portion 32 causes the side portion 12 to rotate slightly in the clockwise direction and causes the side portion 22 to rotate slightly in the counterclockwise direction, the increased downward force will offset the resulting reduced areas of face-to-face contact between the lower surfaces 14 and 24 and the underlying surface. Also, as the lower face of the bridging portion 32 engages that underlying surface, it will provide a third elongated area of enforced contact with that underlying surface. All of this means that the batten bar 10 will provide elongated, wide areas of enforced contact with an underlying surface, whether the bridging portion 32 of that bar is permitted to remain unbent or is forced to bend into engagement with that underlying surface. Moreover, those areas of contact will be much larger than a metal batten bar can provide when its edges are caused to curl upwardly.

The batten bar 10 can be made from several different sturdy, stiff, weather-resistant, solvent-resistant, long-lived, extrudable plastic materials, such as polyvinylchloride, polyethylene, polypropylene, polycarbonate, nylon, and polyesters. The solvents which the material of the bar 10 must be able to resist are alphatic hydrocarbon solvents, aromatic hydrocarbon solvents, halogentated hydrocarbon solvents, ketones and esters of the type which are commonly used in making adhesives for single-ply membranes. Also, the material which is used in making the bar 10 will preferably be stiff enough to be capable of being "cut" to length by having a notch or score formed therein by a razor knife and of then being broken at that notch or score by the mere application of a bending force to that bar. The preferred plastic material is a talc-filled polypropylene; and the bars can be supplied in five (5) or ten (10) foot lengths or can be cut to any desired length at a job site from a coil of batten bar on a spool.

The fixed length batten bars 10 of five (5) or ten (10) feet in length are very useful on those portions of roofs which are free from pipes, ducts, machinery or other things that pass through those roofs. However, on those portions of roofs which are obstructed by pipes, ducts, machinery or other things, it is usually necessary to use batten bars which are non-uniform in length. Where those batten bars are made from plastic material, it is only necessary to form notches or scores in the surface of the coiled batten bar, and then cause the desired lengths of batten bar to break off by a simple bending movement adjacent the notches or scores. Once those lengths have been broken off from the coiled batten bar, they are ready for immediate use. In contrast, where a metal batten bar is to be cut to a non-standard length, it is customery to saw or snip the bar to the desired length, to round the ends of that bar, and then to file or rasp away any burrs or jagged projections which were formed by the sawing or snipping action. This means that it requires more labor to cut a metal batten bar to length than it requires to cut the plastic batten bar of the present invention to length. Furthermore, even after the burrs or jagged projections which are formed by the sawing or snipping action have been filed or rasped away, any burrs and jagged projections along the edges of the metal batten bar will still be present and will be able to abrade or penetrate an overlying membrane.

In FIG. 3, the numeral 46 denotes a single ply membrane of standard and usual type that is used in covering roofs; and the numeral 50 denotes a similar membrane. A fastener 48, which is shown as a self-tapping screw, has the shank there of passed downwardly through one of the holes 42 or 44 or through another of the holes in the bridging portion 32 of a bar 10, and then has that shank forced downwardly through the membrane 46 to be seated in a roof substrate 45. The fasteners 48 are usually driven by power-operated screw-driving tools; and those tools frequently form burrs or jagged projections on the upper edges of the blade-receiving slots in those fasteners. Where the fastener 48 is driven into snug and intimate, but not bending, engagement with the upper surface of the bridging portion 32, the power-operated screw-driving tool is not likely to form any burrs or jagged projections on the upper edges of the blade-receiving slot in that fastener; and hence the upper surface of the fastener can safely be at the level of the rounded upper edges 18 and 28 of the side portions 12 and 22. Where the power-operated screw-driving tool over drives the fastener 48 so far that the bridging portion 32 bends downwardly into engagement with the membrane 46, as shown by FIG. 3, that tool will usually form burrs or jagged projections on the upper edges of the blade-receiving slot of that fastener. Although those burrs or jagged projections will project upwardly above the upper surface of fastener 48, those burrs or jagged projections will not project above the level of the rounded upper edges 18 and 28 of the side portions 12 and 22, because the head of fastener 48 will be displaced downwardly below that level. This means that whether a fastener 48 permits the bridging portion to retain the unbent configuration of FIGS. 1 and 2 or is overdriven to cause that bridging portion to assume the bent configuration of FIG. 3, no part of that fastener will project appreciably above the level of the rounded upper edges 18 and 28 of the side portions 12 and 22. Consequently, the head of the fastener 48 will not tend to abrade or cut an overlying membrane—as the heads of fasteners for metal batten bars almost invariably do.

Further fasteners will be passed downwardly through the remaining holes in bar 10, through the membrane 46, and then seated in the roof substrate 45. The heads of those fasteners also will not project appreciably above the level of the rounded upper edges 18 and 28 of the side portions 12 and 22. As a result, the use of the batten bar 10 tends to prolong the life of any overlying membrane.

The membrane 50 has the major portion thereof in engagement with the roof substrate 45, but it has the left-hand edge thereof overlying the right-hand edge of membrane 46 and also overlying the bar 10 and the fasteners 48. Before the left-hand edge of membrane 50 is placed in the position shown in FIG. 3, adhesive is applied to the underside of that left-hand edge, to the upper face of the right-hand edge of membrane 46, and also to the upper and side surfaces of the bar 10. That adhesive must firmly adhere the left-hand edge of membrane 50 to that bar, as well as to the right-hand edges of membrane 46, because the adherences of that left-hand edge to that bar and to that right-hand edge are the sole assurances that the left-hand part of membrane 50 will remain in protective position over the roof substrate 45. Because the bar 10 is extruded from plastic material, it will be free of the lubricating oil that can be observed on many rolled metal strips; and hence the adhesive can provide a good and full adherence between the surface of that bar and the under surface of the left-hand edge of membrane 50. This means that the lapping of the adjacent edges of membranes 46 and 50 is more secure and is longer lasting than a corresponding lapping where a metal batten bar is used. Also, because the heads of the fasteners 48 are at or below the level of the rounded upper edges 18 and 28 of the side portions 12 and 22 of the bar 10, whereas the heads of fasteners used to secure a metal batten bar to a roof always project above the upper surface of that bar, the "joint" in FIG. 3 is free from the abrading and cutting of the overlapping membrane which frequently occurs when a metal batten bar is used. In addition, because the upper edges 18 and 28 and the outer or side edges 21 and 31 are rounded and are extrusion-smooth, they will not abrade or cut the adjacent portions of the membranes 46 and 48—as do the burred and jagged edges of metal batten bars which have been formed by a punch press. Moreover, the "joint" between the adjacent edges of membranes 46 and 50 in FIG. 3 will be longer-lived than a corresponding "joint" which uses a metal batten bar; because the "cut" ends, and the walls of the drilled holes, as well as all other parts of the batten bar 10, are made from corrosion-resistant plastic. As a result, the bar 10 helps provide highly effective, long-lived "joints" between adjacent membranes.

Where a membrane is secured to a roof which has metal decking incorporated therein, it is important to have the fasteners, which secure the batten bars to the roof, pass into the upper, rather than the lower, corrugations or changes of surface of that metal decking. Where the center-to-center spacings between those upper corrugations or changes of surface are integrally divisible into the center-to-center spacings between adjacent pre-formed holes in the batten bars, it is a simple matter to pass the shanks of fasteners downwardly through the holes in the batten bars, through a membrane, and then through the upper corrugations or changes of surface of the metal decking. However, where the center-to-center spacings between the upper corrugations or changes of surface of the metal decking is not integrally divisible into the center-to-center spacings between adjacent pre-formed holes in the batten bars, it is necessary to form additional holes in the batten bars. Where the batten bars are made from metal, it is necessary to locate a drill and to use it to drill the desired holes in those bars. Also, it would be desirable to locate a file or rasp to remove any burrs or jagged projections that were formed during the drilling of those holes. However, because the batten bar 10 of the present invention is made from plastic material, the fasteners can be made to form their own holes through imperforate areas of the connecting portion 32 of that batten bar. As a result, an installer does not have to spend time locating and using a drill to form holes in the batten bar of the present invention Referring to FIG. 4, the numeral 52 denotes a membrane which has the right-hand edge thereof overlain by the left-hand edge of a membrane 54; and fasteners 48 pass downwardly through holes in the bridging portion 32 of a bar 10 and through both membranes to seat in the roof substrate 45. The numeral 56 denotes an elongated strip or length of membrane which is secured to the left-hand edge of membrane 54 and to the bar 10 by adhesive. The primary difference between the "joint" in FIG. 3 and the "joint" in FIG. 4 is that the batten bar 10 in FIG. 4 mechanically holds the lapping edges of both membranes 52 and 54 to the roof substrate 45, whereas adhesive is relied upon in FIG. 3 to hold the lapping edge of membrane 50 to membrane 46 and to the bar 10. In each of those "joints", the bars 10 will protect the underlying, as well as the overlying, membranes from abrading or cutting; because those bars keep the heads of the fasteners 48 from projecting above the level of the rounded upper edges 18 and 28 of the side portions 12 and 22, and also because those bars confront the adjacent portion of those membranes with smoothly-rounded, extrusion-smooth surfaces.

In FIG. 5, the numeral 58 denotes a membrane which is secured to the roof substrate 45 by a bar 10; and the numeral 60 denotes a strip or length of membrane which is secured to the membrane 58 and to the bar 10 by an adhesive. The securing arrangement shown in FIG. 5 is typical of the securing arrangements that are used to hold down the portions of membranes which are intermediate the joints between adjacent membranes.

FIG. 6 shows, by solid lines, the positions which the membranes 58 and 60 can assume when they are raises upwardly by negative pressures. The dotted lines in FIG. 6 show the position which the center of the strip or length of membrane 60 can assume as it falls, or is driven by wind or pressure, back toward—and then beyond—the normal position which is shown by FIG. 5. It should be noted that every portion of membrane 58, and of the strip or length of membrane 60, which engages a part of the bar 10 as it is moved by pressure, by wind, by pedestrian or vehicular traffic, or by any other means, will engage a rounded surface of that bar which is extrusion-smooth and is free of burrs and jagged projections. This means that the bar 10 enables the membrane 58 to be securely attached to the roof substrate 45 and yet have a long life, because it will not be abraded or cut by burrs and jagged projections of the kind which are found on metal batten bars that have been made by a puhch press.

The membranes 46 and 50 of FIG. 3, and the membranes 52, 54 and 56 of FIG. 4, also can experience the raising which is shown for the membranes 58 and 60 in FIG. 6. In each instance, every portion of every membrane which engages a part of the bar 10, as it is moved by pressure, by wind, by pedestrian or vehicular traffic, or by any other means, will engage a rounded surface of that bar which is extrusion-smooth and is free of burrs and jagged projections. Consequently, it should be apparent that the bar 10 enables membranes to be securely attached to roofs and yet have long and useful lives.

The flat, inclined faces 16 and 26 on the upper surface of bar 10 are useful in causing rain, water or other liquids to rapidly flow away from the bar 10, and also from the "joint" of which it is a part. That rapid flow minimizes the likelihood of rain, water or other liquids accumulating adjacent the exposed edge of membrane 50 in FIG. 3, the exposed edges of membrane 56 in FIG. 4, and the exposed edges of membrane 60 in FIG. 5; and thereby helps promote the water-tight integrity of the "joints" in FIGS. 3–5. Also, the inclined faces 16 and 26 are useful in easing vehicles up, over and past the "joints" of which the bar 10 is a part. The rounded outer or side edges 21 and 31, and the rounded upper edges 18 and 28, are useful in permitting even heavy vehicles to move over "joints", that include bars 10, without abrading or cutting the overlying membranes.

The batten bar 10 is shown in FIG. 2 as having precisely flat lower surfaces 14 and 24 which define a plane; and FIG. 2 also shows the upper and lower surfaces of the bridging portion 32 as being precisely flat and as being parallel to that plane. In actual practice, however, as the bar 10 cools and sets after it has been extruded, the profile of that bar tends to vary from the ideal profile shown in FIG. 2. Specifically, the lower surfaces 14 and 24 may not be precisely flat and/or may not define a plane. Also, the upper and lower surfaces of the bridging portion 22 may not be precisely flat. However, the variations in the profile of batten bar 10, from the ideal profile of FIG. 2, will be limited; and hence the lower surfaces 14 and 24 will be substantially flat and will substantially define a plane. Also, the upper and lower surfaces of the bridging portion 22 will be substantially flat and will be substantially parallel to the plane defined by the lower surfaces 14 and 24.

The lower surfaces 14 and 24 of the batten bar 10 will be flat in side view, and hence those surfaces will be able to apply substantially-continuous, surface-to-surface pressures to underlying membranes all along the length of that bar. Further, because the side portions 12 and 22 have substantial vertical dimensions as well as substantial horizontal dimensions, those side portions will have sufficient ridigity to maintain the bar 10 flat in side view—even when one or more fasteners 48, that are used with that bar, are overdriven, as shown by FIGS. 3–5. This is important; because it completely avoids all of the kinking, looping and distorting which metal batten bars can experience when the fasteners passing through them are overdriven.

If a fastener 48 is properly driven, it will snugly and intimately engage, but will not appreciably bend, the bridging portion 32 of a bar 10; and that bridging portion will distribute the forces, which are applied to it by that fastener, to the side portions 12 and 22—and thence to the lower surfaces 14 and 24. If, however, a fastener 48 is overdriven, as shown by FIGS. 3–5, the bridging portion 32 will not only cause the side portions 12 and 22 to apply downwardly-directed forces to the membrane beneath the lower surfaces 14 and 24, but the lower face of that bridging portion also will apply a downwardly-directed force to that membrane. In such event, the bar 10 will cause three laterally-spaced elongated forces to be applied to the membrane.

As a bar 10 moves or changes from the un-stressed condition of FIGS. 1 and 2 to the bent condition of FIGS. 3–5, the outer edges 21 and 31 will raise slightly upwardly from the idealistic positions shown in FIGS. 3–5. However, because the un-stressed distance from the lower surface of that bridging portion to the plane defined by the lower surfaces 14 and 24 is less than one-sixteenth (1/16) of an inch, and because the offsets 20 and 30 are less than three eighths (⅜) of an inch from the outer edges 21 and 31, the raising of those outer edges will be very limited. Further, because each membrane usually is forty-five thousandths (0.045) of an inch thick and is yieldable, the raising of the outer or side edges 21 and 31 of a bar 10 is almost imperceptible.

It is customary to space the ends of aligned batten bars apart so rain, water and other liquids can flow between the ends of adjacent bars. The batten bars 10 permit such spacing with minimum abrading of the overlying membranes, because bars can be cut from a coil on a spool without forming burrs or jagged edges on the ends thereof.

The batten bar provided by the present invention can be used as a part of a newly-installed roof, or can be used as a part of a re-roofing arrangement. That bar has met the rigorous tests which are performed on batten bars in a Kesternick Cabinet. Also, joints which include the batten bar provided by the present invention have passed the rigorous, industry-accepted, Class I-60 and Class I-90 tests. As a result, that batten bar constitutes an important and unique advance in the roofing art.

Whereas the drawing and accompanying description have shown and described a preferred embodiment of the present invention, it should be apparent to those skilled in the art that various changes can be made in the form of the invention without affecting the scope thereof.

What we claim is:

1. A method of affixing a roofing membrane to a roof substrate which comprises placing a section of roofing membrane on said roof substrate, placing an extrusion-smooth batten bar having an open groove is an upper face on a part of the exposed surface of said section of roofing membrane, passing fasteners into said open groove, downwardly through said extrusion-smooth batten bar and through said section of roofing membrane and into said roof substrate to firmly and continuously secure said extrusion-smooth batten bar and said section of roofing membrane to said roof substrate throughout the length of said extrusion-smooth batten bar, applying an adhesive to portions of said section of roofing membrane at opposite sides of and adjacent to said extrusion-smooth batten bar, placing a further section of roofing membrane over the upper face of said extrusion-smooth batten bar and over the adhesive-coated portions of the first said membrane, and pressing said further section of roofing membrane into engagement with the extrusion-smooth upper face of said extrusion-smooth batten bar and with said portions of said section of roofing membrane at opposite sides of and adjacent to said extrusion-smooth batten bar whereby the open groove permits said further section of roofing membrane to remain out of engagement with substantially all portions of said fasteners.

2. A method of affixing a roofing membrane to a roof substrate as claimed in claim 1 wherein said extrusion-smooth batten bar has said elonated groove in said upper face thereof which has a depth that at least substantially corresponds to the thickness of the head of each of said fasteners.

3. A method of affixing a roofing membrane to a roof substrate as claimed in claim 9 wherein said extrusion-smooth batten bar has smoothly rounded elongated side edges.

4. A method of affixing a roofing membrane to a roof substrate as claimed in claim 1 wherein said extrusion-smooth batten bar has said elongated groove in said upper face thereof which has a depth that at least substantially corresponds to the thickness of the head of each of said fasteners, and wherein said elongated groove has smoothly rounded elongated side edges.

5. A method of affixing a roofing membrane to a roof substrate as claimed in claim 1 wherein said extrusion-smooth batten bar has a plastic upper face to which an adhesive readily adheres, whereby said adhesive that is applied to said upper face said extrusion-smooth batten bar will provide a firm, adherent bond between said upper face of said extrusion-smooth batten bar and the under surface of said further section of roofing membrane.

6. A batten bar and an underlying unitary membrane held thereby which comprise an elastomeric or thermoplastic membrane and a non-metallic, plastic batten bar, said bar having an upper face and a lower face and having said lower face placed upon, and secured in overlying, confining and holding relation to, closely-spaced areas of said unitary membrane, said bar having a first elongated side portion that has an elongated membrane-engaging and holding surface which constitutes part of said lower face of said batten bar and which is engageable with one of said closely-spaced areas of said unitary membrane and also having a second elongated side portion that has an elongated membrane-engaging and holding surface which constitutes a further part of said lower face of said batten bar and which is engageable with another of said closely-spaced areas of said unitary membrane, said bar having an elongated connecting portion that extends between and interconnects said first and second elongated side portions, said bar having a first elongated surface on said first elongated side portion that is part of said upper face of said batten bar and that helps define one side of an elongated, open groove in said upper face, said elongated, open groove being, at least in part, coextensive with said elongated connecting portion, said bar having a second elongated surface on said second elongated side portion that is part of said upper face of said batten bar and that helps define a second side of said elongated, open groove in said upper face, said first and second elongated membrane-engaging surfaces on said first and second elongated side portions generally defining a plane for said lower face of said batten bar, said elongated connecting portion having an upper face which serves as the bottom of said elongated, open groove and having a lower face which serves as part of said lower face of said batten bar, said upper face of said elongated connecting portion being adapted to receive forces applied to it by the heads of fasteners which pass through said elongated connecting portion and have the heads thereof substantially wholly disposed within said elongated, open groove in said upper face of said batten bar and to distribute said forces to said first and second elongated side portions and thence to said first and second elongated membrane-engaging surfaces, said elongated connecting portion being adapted to bend in response to heavy forces and to develop restorative forces therein which tend to hold said first and second elongated side membrane-engaging surfaces of said first and second elongated side members in intimate holding and confining contact with said closely-spaced areas of said unitary membrane, said first elongated surface on said first elongated side portion and said second elongated surface on said second elongated side portion always remaining spaced apart a substantial distance even when said elongated connecting portion is bent, an overlying membrane, and adhesive that bonds said overlying membrane to said closely-spaced areas of said unitary membrane, said bar having extrusion-smooth upper and lower faces.

7. A batten bar and an underlying membrane as claimed in claim 6 wherein said first and second elongated surfaces on said first and second elongated side portions constitute the uppermost portions of said upper surface of said batten bar, and wherein said first and second elongated surfaces on said first and second elongated side portions are smoothly rounded.

8. A batten bar and an underlying membrane as claimed in claim 6 wherein said elongated connecting portion can be penetrated, and can have holes formed therein, by forcing fasteners against and through imperforate areas of the upper surface of said elongated connecting portion.

9. A batten bar and an underlying membrane as claimed in claim 6 wherein said first and second elongated surfaces on said first and second elongated side portions constitute the uppermost portions of said upper surface of said batten bar, and wherein said first and second elongated surfaces on said first and second elongated side portions are smoothly rounded, and wherein said lower face of said elongated connecting portion is displaced upwardly from said plane, which is defined by said first and second elongated membrane-engaging surfaces on said first and second elongated side portions, whenever said batten bar is in an unstressed state.

* * * * *